US005352996A

United States Patent [19]

Kawaguchi

[11] Patent Number: 5,352,996

[45] Date of Patent: Oct. 4, 1994

[54] INTERDIGITAL BANDPASS FILTER

[75] Inventor: Ei Kawaguchi, Kanagawa, Japan

[73] Assignee: Leader Electronics Corp., Kanagawa, Japan

[21] Appl. No.: 11,144

[22] Filed: Jan. 29, 1993

[30] Foreign Application Priority Data

Jan. 30, 1992 [JP] Japan ..... 4-015080

[51] Int. Cl.[5] ..... H01P 1/205

[52] U.S. Cl. ..... 333/203; 29/600

[58] Field of Search ..... 333/202-205; 29/600

[56] References Cited

U.S. PATENT DOCUMENTS 3,525,954 8/1970 Rhodes ..... 333/203

4,034,319 7/1977 Olsson ..... 333/203

OTHER PUBLICATIONS

Munenori Ishii, Seizou Azuma, Toshio Aoki, and Kunio Oi, "Microwave Circuit", pp. 122-125, published on Feb. 28, 1969 by Nikkan Kogyo Simbun-sha.

George L. Matthaei, Leo Young, E. M. T. Jones, "Microwave Filter, Impedance-Matching Networks, and Coupling Structures", 1964, by McGraw-Hill, Inc.

Arne Brejning Dalby, "Interdigital Microstrip Circuit Parameters Using Empirical Formulas and Simplified Model", IEEE Transactions on Microwave theory and Techniques, vol. MTT-27, No. 8, Aug. 1979, pp. 744-752.

*Primary Examiner*—Seungsook Ham

*Attorney, Agent, or Firm*—Fish & Richardson

[57] ABSTRACT

An interdigital bandpass filter is provided which presents improved performance and is easy to manufacture. The filter is provided with a resonator plate which includes a plurality of resonator elements formed integrally with the resonator plate. For defining a space for accommodating these resonator elements, spacer plates are formed with respective openings. The filter is assembled by stacking the spacer and resonator plates and case plates and securing them to each other. Input/output conductors are coupled to the resonator elements through coaxial line coupling portions which are provided in such a manner that they extend in directions intersecting with the plane of the resonator plate toward the accommodating space.

14 Claims, 5 Drawing Sheets

INTERDIGITAL BANDPASS FILTER

BACKGROUND OF THE INVENTION

1. Field of the Invention

The present invention relates to an interdigital bandpass filter for use in a microwave band or a submicrowave band.

2. Description of the Prior Art

An interdigital bandpass filter (hereinafter abbreviated as "the IBP filter") is, as is well-known, structured such that a plurality of resonator elements are arranged at selected intervals. Each of the resonator elements comprises a quarter wavelength line which has one end open-circuited and the other end short-circuited. Conventional IBP filters of this kind may be generally classified into three types. The first type is a cylindrical rod (or square rod) IBP filter, an example of which is described in "Microwave Circuit" by Munenori Ishii, Seizou Azuma, Toshlo Aoki and Kunlo Oi, pp.122–125, published on Feb. 28, 1969 by Nikkan Kogyo Simbunsha. This first type of IBP filter comprises resonators constituted of cylindrical metal rods of different diameters which are mounted in a metal case (the case is grounded) such that the resonators alternately extend from the opposite sides of the inner surfaces of the metal case within the space defined in the metal case.

The second type of IBP filter is composed of a pair of comb-like resonator arrays, each comprising a plurality of integrated resonator elements in parallel with each other, wherein the combs are interdigitated. An example of this type is described in "Microwave Filters, Impedance-Matching Networks, and Coupling Structures", by George L. Matthaei, Leo Young and E.M.T. Jones, pp.621–631, published by McGraw-Hill Book Company in 1964.

The third type of IBP filter employs microstrip lines. An example of the third type is described in the article "Interdigital Microstrip Circuit Parameters Using Empirical Formulas and Simplified Model", by Arne Brejning Dalby, pp.744–752, IEEE Transactions On Microwave Theory and Techniques Vol. MTT-27, No. 8, August, 1979. This IBP filter is formed by employing, for example, a dielectric substrate which has both surfaces covered with copper foil, patterning one of the copper layers, and leaving a plurality of strip lines in parallel with each other (each line constitutes a resonator element).

In the conventional IBP filters as described above, the first and second types generally present good performance (for example, in terms of loss in a pass band, flatness of the characteristics in the band, attenuation characteristics on both sides of the pass band), but are not appropriate for mass production, while the third type presents good mass-productivity but is inferior in performance.

More specifically, the first type of IBP filter requires, for precisely mounting in a metal case resonators of different diameters with selected different intervals therebetween, fine machining of the respective resonator elements (lathe machining), solid machining (cutting, casting and so on) of the metal case, fine machining of the fixing means for mounting the resonator elements in the metal case (for example, threading of the resonator elements, drilling of screw holes into the metal case, etc.). Since the filter uses a number of parts and is assembled by a number of processes, it is not appropriate for mass production. Also, since the filter is structured such that individual resonator elements are separately mounted in a metal case, it is susceptible to the influence of mechanical vibrations.

The second type of IBP filter must precisely arrange a pair of resonator array combs relative to each other, and therefore generally requires fine adjustment of the relative distance of the combs. For this reason, like the first type, it is not appropriate for mass production.

Although it is relatively easy to form resonator elements to precise sizes and arrange them relative to each other in the third type of IBP filter, this filter employs a dielectric (not air) substrate which results in greater high frequency loss. Further, since it is not provided with a case for covering strip lines, electromagnetic radiation occurs. This filter, therefore, has the problems that Q is low and the selection characteristic is bad as compared with the foregoing two types.

SUMMARY OF THE INVENTION

It is therefore an object of the present invention to provide an interdigital bandpass filter which presents good performance and has a filter structure easy to manufacture.

To achieve the above object, the present invention provides an interdigital bandpass filter which is structured such that all resonator elements required for the filter are integrally formed. To realize this integral formation, an input conductor and output conductor are coupled to the resonator elements in a direction intersecting or crossing with a plane on which the resonator elements extend.

According to the present invention, an interdigital bandpass filter may comprise an upper case plate defining the top of the resonator accommodating space; a lower case plate defining the bottom of the resonator accommodating space; an upper spacer plate having an opening for defining part of the side of the resonator accommodating space; a lower spacer plate having an opening for defining part of the side of the resonator accommodating space; and a resonator plate sandwiched between the top and bottom case plates through the upper and lower spacer plates, the resonator plate having an opening for defining part of the side of the resonator accommodating space and comprising a plurality of resonator elements extending on a common resonator plane within the resonator accommodating space.

Further, according to the present invention, the bandpass filter may also comprise: an input conductor coupling member for providing a coupling between a pair of input conductors and one of said plurality of resonator elements of said resonator plate, said input conductor coupling member extending from the outside of said bandpass filter into said resonator accommodating space in a direction intersecting with said resonator plane; and an output conductor coupling member for providing a coupling between a pair of output conductors and another one of said plurality of resonator elements of said resonator plate, said output conductor coupling member extending from the outside of said bandpass filter into said resonator accommodating space in a direction intersecting with said resonator plane.

DESCRIPTION OF THE PREFERRED EMBODIMENTS

One embodiment of the present invention will hereinafter be described with reference to the accompanying drawings.

Figure 1:
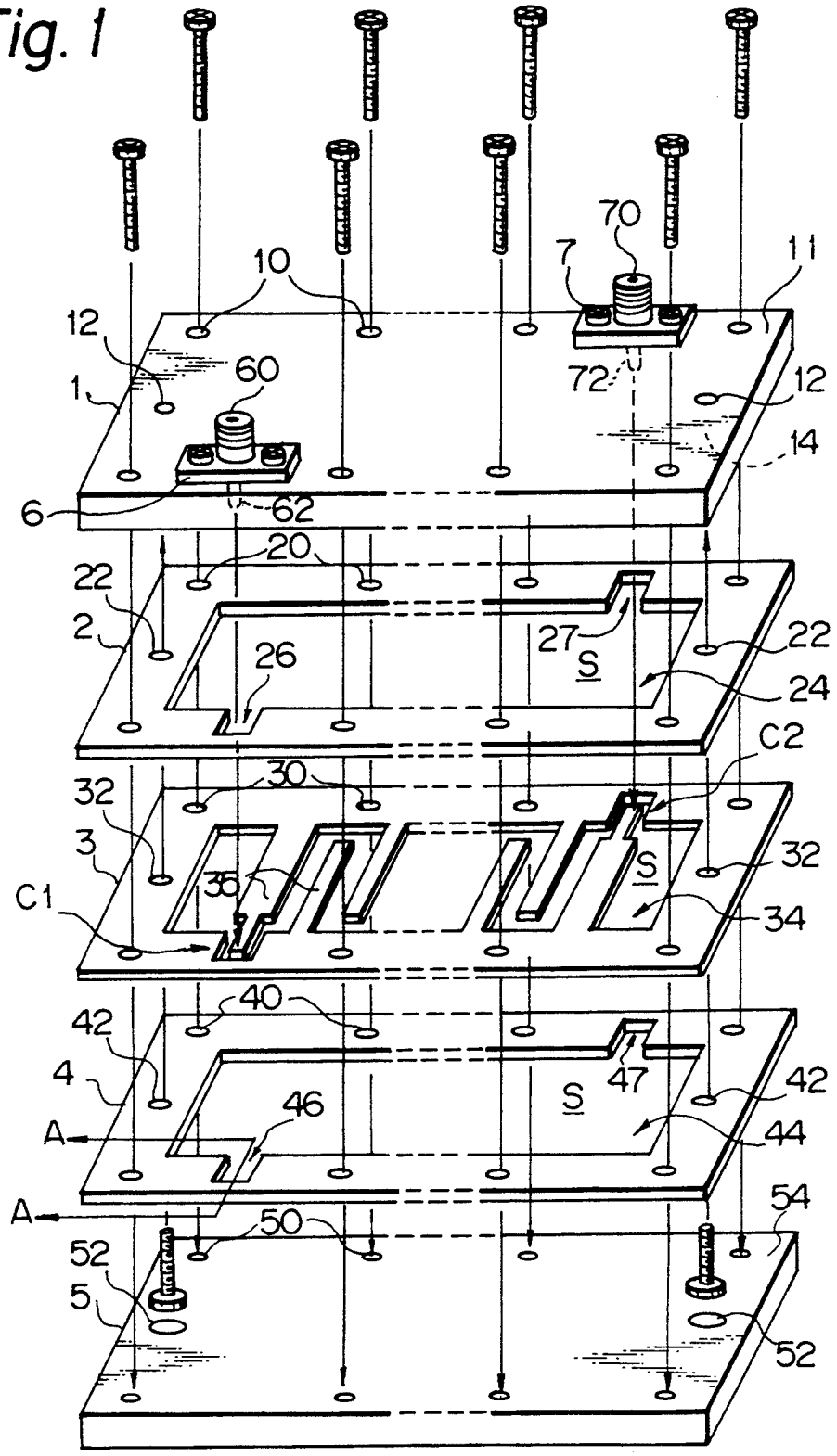
FIG. 1 is an exploded schematic view of an interdigital bandpass filter according to the present invention.
Figure 2:
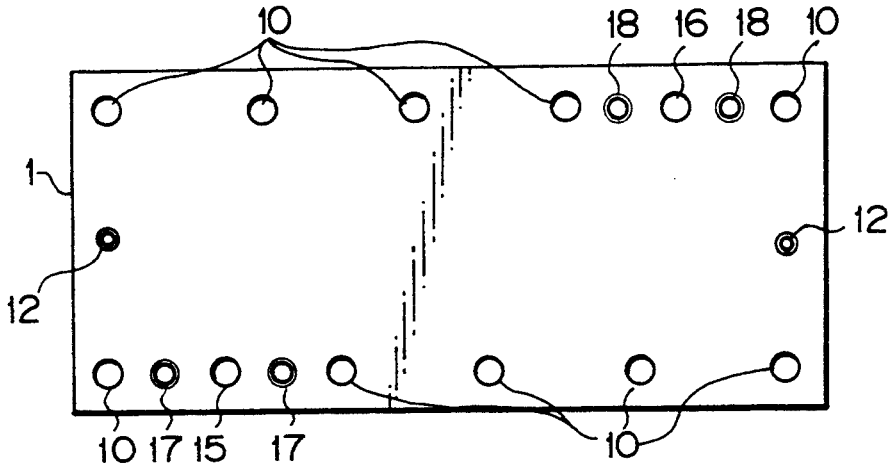
FIG. 2 is a top plan view of an upper case plate shown in FIG. 1.
Figure 3:
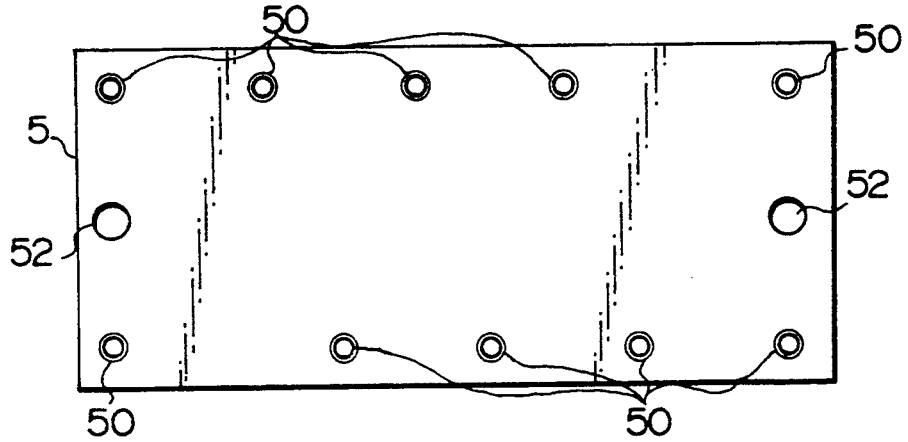
FIG. 3 is a top plan view of a lower case plate shown in FIG. 1.

FIG. 1 is an exploded pictorial view illustrating the structure of an interdigital bandpass (IBP) filter according to the present invention for easy understanding. FIGS. 2–5 show top plan views of plates used for the structure illustrated in FIG. 1 which are designed to be used in a microwave band of 4 GHz (FIG. 1 conceptually shows the arrangement of the resonator elements for simplicity).

As shown in FIG. 1, the IBP filter comprises, in order from the top, an upper case plate 1, an upper spacer plate 2, a resonator plate 3, a lower spacer plate 4 having the same shape as plate 2, and a lower case plate 5. These plates are all generally rectangular and made of metal. The filter is also provided with high frequency input and output connectors 6 and 7 which have coaxial outer conductors 60, 70 and inner conductors 62, 72, respectively, and are mounted on the upper surface 11 of the upper case plate 1.

Figure 4:
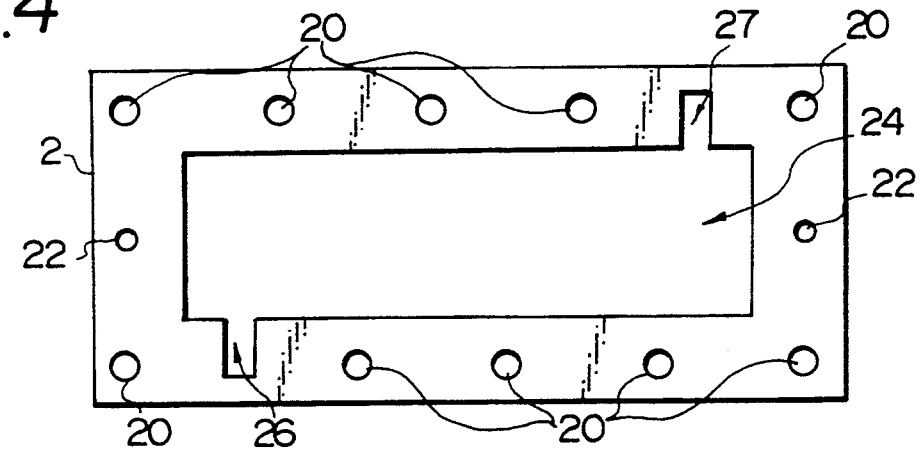
FIG. 4 is a top plan view of a spacer plate shown in FIG. 1.
Figure 5:
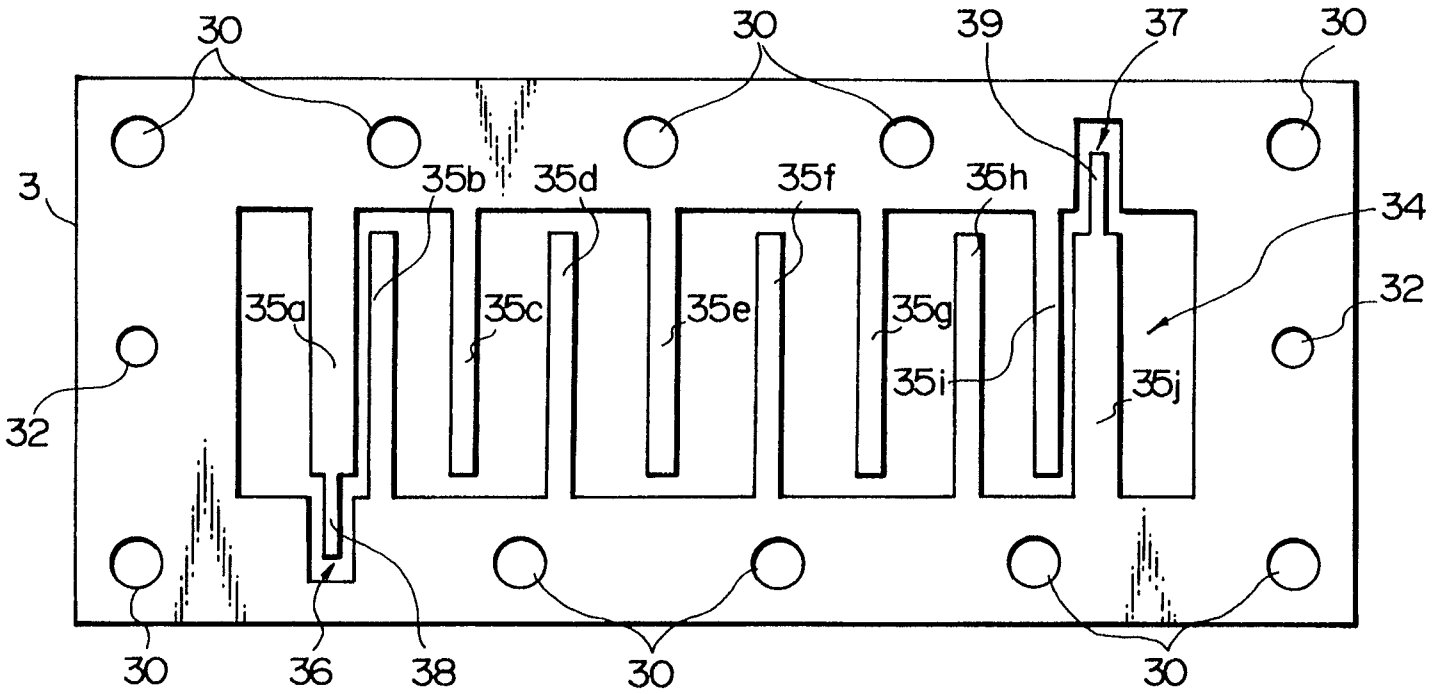
FIG. 5 is an enlarged top plan view of a resonator plate shown in FIG. 1.

For securing the plates constituting the filter to each other, the respective plates are formed with non-threaded holes and/or threaded holes along the longitudinal sides thereof at different corresponding positions. More specifically, plate 1 is formed with a plurality of non-threaded holes 10 (see also FIG. 2), plate 2 with a plurality of non-threaded holes 20 (since plates 2 and 4 are the same, plate 2 only is shown in FIG. 4), plate 3 with a plurality of non-threaded holes 30 (see also the enlarged view of FIG. 5), and plate 4 with a plurality of non-threaded holes 40. The lower case plate 5 is also formed with a plurality of threaded holes 50 (see also FIG. 3). In order for the upper four of the five plates to be temporarily tacked during manufacturing, at the center of each short side thereof, the upper four plates include threaded holes 12, non-threaded holes 22, non-threaded holes 32 and non-threaded holes 42, respectively, while the lower plate 5 is formed with holes each for accommodating a screw head. Further, the upper case plate 1 includes holes 15 and 16 (shown in FIGS. 2 and 7) which have a diameter slightly smaller than the inner diameter of the outer conductors 60 or 70 of each of the connectors 6 and 7, and pairs of threaded holes 17 and 18 (shown in FIG. 2) for mounting the respective connectors on the case plate 1.

Next, a resonator portion of the IBP filter according to the present invention will be explained. First, a space for accommodating resonator elements will be explained. The plates 2, 3 and 4 are provided with openings 24, 34 and 44 of the same generally rectangular outline. The side surfaces of the respective plates defining the openings, the lower surface 14 of the upper plate 1, and the upper surface 54 of the lower plate 5 define a rectangular parallelepiped space S for accommodating resonator elements in which air serves as a dielectric material.

The resonator plate 3 is provided with a multiplicity of resonator elements 35 integrally formed with the plate 3. The elements 35 alternately protrude from the opposite sides of the opening 34 into the space S. The resonator plate shown in FIG. 5 comprises 10 resonator elements 35*a*–35*j*, where two of the elements 35*a* and 35*j* located at both extreme ends function as couplers. The length, width, thickness (or plate thickness), cross-sectional shape (rectangular in the illustrated example), intervals between adjacent resonator elements or between the end elements and the plate 3 are determined depending on required filter characteristics. Accuracy of the dimensions mainly determines the performance of the filter.

In association with the integrally formed resonator plate, the IBP filter is provided with coaxial line coupling portions C1 and C2 which extend in directions generally intersecting with the plane of the plate 3 (in the orthogonal direction in the illustrated embodiment) to facilitate the coupling of the resonator elements 85*a* and 85*j* to the input connector (or input conductors) and the output connector (or output conductors), respectively. The coupling portions C1 and C2 will be next described. However, since the coupling portions are similarly structured, coupling portion C1 will be primarily explained.

For coupling the coupler element 35*a* to the input connector 6, the coaxial line coupling portion C1 is constituted of an L-shaped coaxial line, where an outer conductor thereof is formed of a circular hole 15 (16 for C2) and rectangular notches 26, 36 and 46 (27, 37 and 47 for C2), while an inner conductor thereof is formed of a protrusion 38 (39 for C2) having a rectangular cross section. More specifically, the notches 26, 36 and 46 of the same outlines are provided to the respective plates 2, 3 and 4 adjacent to the respective openings 24, 34 and 44 thereof and in the vicinity of the tip of the associated element 35*a*. The protrusion 38 having the same width is integral with the element 35*a* and extends to the vicinity of the center of the notch 36 in the same longitudinal direction as the element 35*a*. Also, the circular hole 15 is formed through the plate 1 such that the axis thereof substantially orthogonally crosses with the protrusion 38 at the tip thereof. The diameter of the hole 15 is slightly shorter than the inner diameter of the outer conductor 60 of the connector 6, as mentioned above (see FIG. 6). It should be noted that, in this form of coaxial line structure (that is, the inner conductor is rectangular in cross section, and the cross sections of the spaces defined by the outer conductors are circular and rectangular), any one skilled in the art can determine the dimensions of the holes, notches and protrusions and a variety of other dimensions associated with the relative positional relationship between them and coupler elements for establishing a required characteristic impedance and a required impedance matching of a connector with a coupler element, in accordance with data presented in, for example, Microwave Engineer's Handbook—Volume One. The length of the inner conductor 62 or 73 of each of the connectors 6 and 7 is selected to be long enough to cause the tip of the inner conductor to substantially abut on the upper surface of the tip of the associated protrusion 38 or 39 when the connector is mounted on the plate 1 and the plates 1, 2, 3 and 4 are secured to each other.

Next, a method of manufacturing the IBP filter of the present invention will be described. First, since high dimensional accuracy is not required for plates 1, 2, 4 and 5 because they do not exert much influence on the performance of the filter, they are punched by a press from metal plates of respective selected thicknesses, for example, in a dimensional accuracy equal to 25/100 mm (they may be plated after the punching if necessary). Next, the resonator plate 3 is prepared by cutting a metal plate of a selected thickness, for example, In a dimensional accuracy equal to 5/100 mm (after the cutting, it may be plated if necessary). Cutting of a high dimensional accuracy of 5/100 mm may be achieved by a laser cutter. It should be noted that a laser cutter permits an extremely high dimensional accuracy to be realized up to 2/100 mm. Then, the prepared plates 1, 2, 3 and 4 are temporarily fixed by screws shown in FIG. 1, and the connectors 6 and 7 are mounted on the plate 1 with screws. Next, from the bottom surface of the plate 4, the inner conductors 62 and 72 are respectively soldered to the protrusions 38 and 39. Then, the temporarily fixed flour plates and the remaining plate 5 are secured to each other with screws shown in FIG. 1, thus completing the filter. As will be understood from the above explanation, high dimensional accuracy is required only for the formation of the resonator plate. Thus, it is not necessary to pay special attention to dimensional accuracy when assembling the resonator plate with the other plates.

Figure 6:
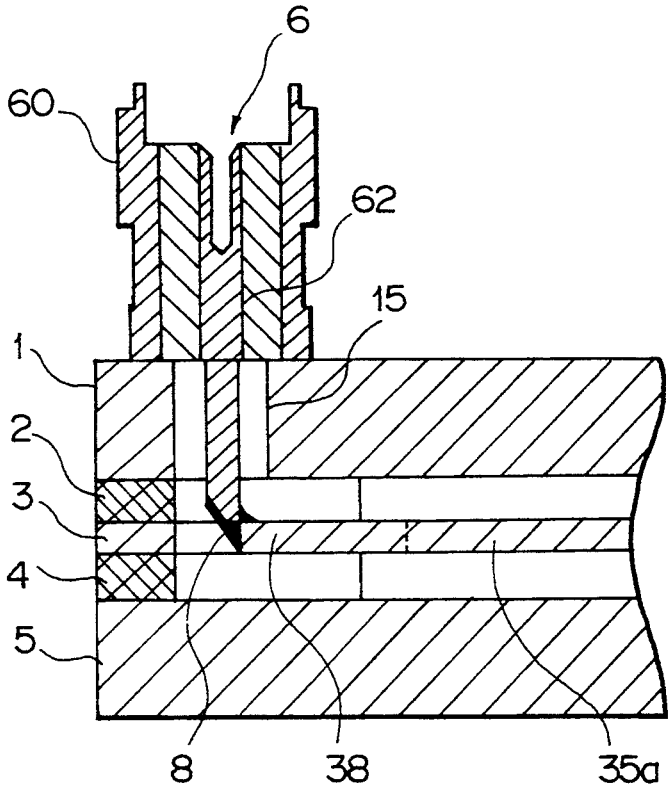
FIG. 6 is a cross-sectional view taken along line A—A of the filter shown in FIG. 1 in its assembled state, showing a connection of the inner conductor of a high frequency terminal connector with the protrusion of a resonator element.

FIG. 6 illustrates a cross-sectional view of the assembled filter taken along line A—A in FIG. 1. As can be seen from the figure, the tip of the inner conductor 62 is secured by the solder 8 to the tip of the protrusion 38 as mentioned above.

Figure 7:
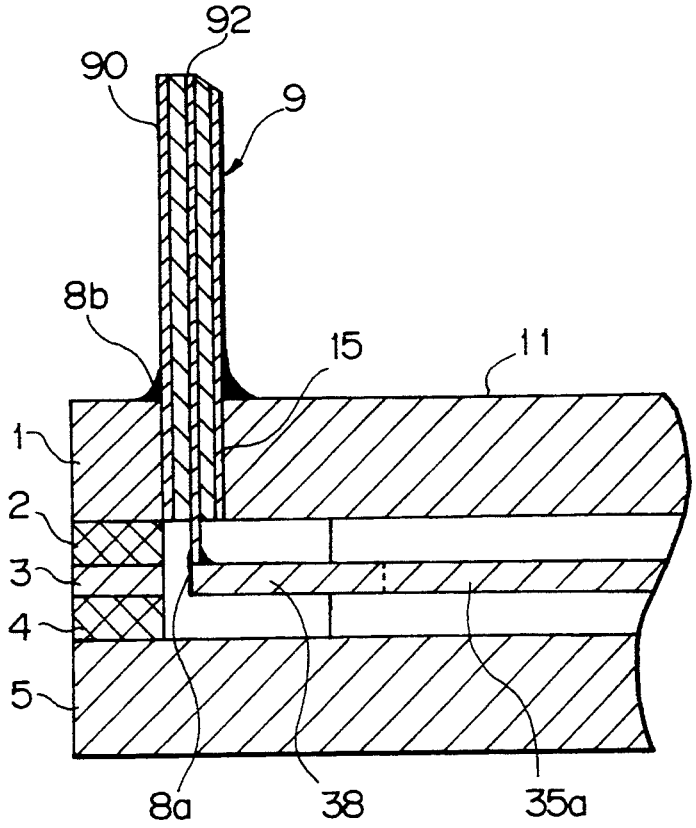
FIG. 7 is a cross-sectional view similar to FIG. 6 illustrating a direct connection of the inner conductor of a coaxial cable to the protrusion of a resonator element without using a high frequency connector.

While one embodiment of the IBP filter according to the present invention has been described in the foregoing, the following modifications are possible. First, if necessary, the input/output conductors may be connected to the coupler elements in any direction which intersects with the resonator plate plane, rather than directions orthogonal thereto, as long as the integral formation of the resonator plate is not prevented. Secondly, as for the method of connecting the input/output conductors to the coupler elements, the input/output coaxial cables may be directly coupled to the filter without employing the connectors used in the foregoing embodiment. In this case, as shown in FIG. 7, an inner conductor 92 of an input coaxial cable 9 may be directly secured to a protrusion 38 with a solder 8*a*, while an outer conductor 90 thereof may extend to the lower surface of a plate 1 through a hole 15 and may be secured to the plate 1 by a solder 8*b* around the hole 15 on the upper surface 11 of the plate 1. Thirdly, use of coaxial connectors (not shown) having spring-biased central contacts, in place of the connectors 6 and 7, which have fixed inner conductors, can eliminate the soldering of inner conductors to associated protrusions. Further, although coupling of input/output conductors to the coupler elements of a resonator is preferably made through coaxial-line coupling portions which have a required characteristic impedance, by means of a hole/-protrusion/notch combination, an alternative method may be used if necessary. For example, if such protrusions and notches as mentioned above are not provided, the tip of each coupler element may be used as a point for coupling an input or output conductor or connector to the resonator in a direction intersecting with the plane of the tip.

According to the interdigital bandpass filter of the present invention as described above, since the resonator is integrally formed, it is not susceptible to the influence of mechanical vibrations. Also, the dimensional accuracy of the resonator elements is readily increased, so that the performance of the filter can be improved. It has been found that the increase in the dimensional accuracy of the resonator results in enhanced flatness of the pass band characteristic of the filter, thereby reducing loss in that pass band. The present invention, therefore, provides an IBP filter of improved performance. Also, the plate components constituting the filter can be formed by simple machining of metal plates, such as punching, cutting-out, etc., thereby removing the necessity of complicated machining including shaping and casting. Further, since the number of parts can be reduced, manufacturing and assembling are simplified, resulting in a greatly decreased manufacturing cost.

What is claimed is:

1. An interdigital bandpass filter having a space for accommodating a resonator, said filter comprising:

a plate integrally including a plurality of resonator elements, said resonator elements being arranged to extend in said resonator accommodating space, said plurality of resonator elements extending in a common plane;

an input conductor coupling portion extending in a direction intersecting with said common plane to said resonator accommodating space for coupling an input conductor to one of said plurality of resonator elements; and an output conductor coupling portion extending in a direction intersecting with said common plane to said resonator accommodating space for coupling an output conductor to another one of said plurality of resonator elements.

2. A interdigital bandpass filter having a resonator accommodating space therein comprising:

an upper case plate defining said top of said resonator accommodating space;

a lower case plate defining said bottom of said resonator accommodating space;

an upper spacer plate having an opening for defining part of said side of said resonator accommodating space;

a lower spacer plate having an opening for defining part of said side of said resonator accommodating space;

a resonator plate sandwiched between said upper and said lower case plates through said upper and said lower spacer plates, said resonator plate having an opening for defining part of said side of said resonator accommodating space and integrally including a plurality of resonator elements extending in a common resonator plane within said resonator accommodating space;

an input conductor coupling member for providing a coupling between a pair of input conductors and one of said plurality of resonator elements of said resonator plate; and an output conductor coupling member for providing a coupling between a pair of output conductors and another one of said plurality of resonator elements of said resonator plate.

3. An interdigital bandpass filter according to claim 2, wherein said input conductor coupling member extends from the outside of said bandpass filter into said resonator accommodating space in a direction intersecting with said common resonator plane; and said output conductor coupling member extends from the outside of said bandpass filter into said resonator accommodating space in a direction intersecting with said common resonator plane.

4. A bandpass filter according to claim 3, wherein said input conductor coupling member comprises:

a first notch formed in said resonator plate adjacent to said opening and in the vicinity of a tip of said one resonator element of said resonator plate;

a first protrusion extending from the tip of said one resonator element into said first notch and being integral with said one resonator element;

a notch formed in each of said upper and said lower spacer plates to be matched with said first notch of said resonator plate; and a first hole formed through one of said upper and said lower case plates and having an axis thereof substantially orthogonal to the upper surface of said first protrusion in the vicinity of a tip thereof, and wherein said output conductor coupling member comprises:

a second notch formed in said resonator plate adjacent to said opening and in the vicinity of a tip of said another one of said plurality of resonator elements of said resonator plate;

a second protrusion extending from the tip of said another one of said plurality of resonator elements into said second notch and being integral with said another one of said plurality of resonator elements;

a notch formed in each of said upper and said lower spacer plates to be matched with said second notch of said resonator plate; and a second hole formed through said one of said upper and said lower case plates and having an axis thereof substantially orthogonal to the upper surface of said second protrusion in the vicinity of a tip thereof.

5. A bandpass filter according to claim 4, further comprising:

an input connector mounted on an outer surface of said one of said upper and said lower case plates at the site of said first hole, said input connector having coaxial inner and outer conductors, said inner conductor of said input connector being coupled to said first protrusion in the vicinity of the tip thereof through said first hole, said inner and outer conductors of said input connector being adapted for connection to said pair of input conductors, respectively; and an output connector mounted on the surface of said one of said upper and said lower case plates at the site of said second hole, said output connector having coaxial inner and outer conductors, said inner conductor of said output connector being coupled to said second protrusion in the vicinity of the tip thereof through said second hole, said inner and outer conductors of said output connector being adapted for connection to said pair of output conductors, respectively.

6. A bandpass filter according to claim 4, further comprising:

an input cable having inner and outer conductors, said inner conductor extending through said first hole from the outer surface of said one of said upper and said lower case plates and being connected to said first protrusion in the vicinity of the tip thereof, said outer conductor being connected to said one of said upper and said lower case plates around said first hole thereof, said inner and outer conductors of said input cable comprising said pair of input conductors, respectively; and an output cable having inner and outer conductors, said inner conductor extending through said second hole from the outer surface of said one of said upper and said lower case plates and being connected to said second protrusion in the vicinity of the tip thereof, said outer conductor being connected to said one of said upper and said lower case plates around said second hole thereof, said inner and outer conductors of said output cable comprising said pair of output conductors respectively.

7. A bandpass filter according to claim 3, wherein said input conductor coupling member comprises:

a first hole formed through one of said upper and said lower case plates and having an axis thereof substantially orthogonal to the upper surface of said one resonator element in the vicinity of a tip thereof, and wherein said output conductor coupling member comprises:

a second hole formed through said one of said upper and said lower case plates and having an axis thereof substantially orthogonal to the upper surface of said another one of said plurality of resonator elements in the vicinity of a tip thereof.

8. A bandpass filter according to claim 7, further comprising:

an input connector mounted on an outer surface of said one of said upper and said lower case plates at the site of said first hole, said input connector having coaxial inner and outer conductors, said inner conductor of said input connector being coupled to said one resonator element in the vicinity of the tip thereof through said first hole, said inner and outer conductors of said input connector being adapted for connection to said pair of input conductors, respectively; and an output connector mounted on the outer surface of said one of said upper and said lower case plates at the site of said second hole, said output connector having coaxial inner and outer conductors, said inner conductor of said output connector being coupled to said another one of said plurality of resonator elements in the vicinity of the tip thereof through said second hole, said inner and outer conductors of said output connector being adapted for connection to said pair of output conductors, respectively.

9. A bandpass filter according to claim 7, further comprising:

an input cable having inner and outer conductors, said inner conductor extending through said first hole from the outer surface of said one of said upper and said lower case plates and being connected to said one resonator element in the vicinity of the tip thereof, said outer conductor being connected to said one of said upper and said lower case plates around said first hole thereof, said inner and outer conductors of said input cable comprising said pair of input conductors, respectively; and an output cable having inner and outer conductors, said inner conductor extending through said second hole from the outer surface of said one of said upper and said lower case plates and being connected to said another one of said plurality of resonator elements in the vicinity of the tip thereof, said outer conductor being connected to said one of said upper and said lower case plates around said second hole thereof, said inner and outer conductors of said output cable comprising said pair of output conductors, respectively.

10. An interdigital bandpass filter having a resonator accommodating space therein comprising:

an upper case plate defining the top of said resonator accommodating space;

a lower case plate defining the bottom of said resonator accommodating space;

an upper spacer plate having an opening for defining part of the side of said resonator accommodating space;

a lower spacer plate having an opening for defining part of the side of said resonator accommodating space; and a resonator plate sandwiched between said upper and said lower case plates through said upper and lower spacer plates, said resonator plate having an opening for defining part of the side of said resonator accommodating space and integrally including a plurality of resonator elements extending in a common resonator plane within said resonator accommodating space;

an input conductor coupling member for providing a coupling between a pair of input conductors and one of said plurality of resonator elements of said resonator plate, said input conductor coupling member extending from the outside of said bandpass filter into said resonator accommodating space in a direction intersecting with said common resonator plane, said input conductor coupling member comprising:

a first notch formed in said resonator plate adjacent to said opening and in the vicinity of a tip of said one resonator element of said resonator plate;

a first protrusion extending from the tip of said one resonator element into said first notch and being integral with said one resonator element;

a notch formed in each of said upper and lower spacer plates to be matched with said first notch of said resonator plate; and a first hole formed through one of said upper and said lower case plates and having an axis thereof substantially orthogonal to the upper surface of said first protrusion in the vicinity of a tip thereof, an output conductor coupling member for providing a coupling between a pair of output conductors and another one of said plurality of resonator elements of said resonator plate, said output conductor coupling member extending from the outside of said bandpass filter into said resonator accommodating space in a direction intersecting with said common resonator plane, said output conductor coupling member comprising:

a second notch formed in said resonator plate adjacent to said opening and in the vicinity of a tip of said another one of said plurality of resonator elements of said resonator plate;

a second protrusion extending from the tip of said another one of said plurality of resonator elements into said second notch and being integral with said another one of said plurality of resonator elements;

a notch formed in each of said upper and lower spacer plates to be matched with said second notch of said resonator plate; and a second hole formed through said one of said upper and said lower case plates and having an axis thereof substantially orthogonal to the upper surface of said second protrusion in the vicinity of a tip thereof;

an input connector mounted on an outer surface of said one of said upper and said lower case plates at the site of said first hole, said input connector having coaxial inner and outer conductors, said inner conductor of said input connector being coupled to said first protrusion in the vicinity of the tip thereof through said first hole, said inner and outer conductors of said input connector being adapted for connection to said pair of input conductors, respectively; and an output connector mounted on the outer surface of said one of said upper and said lower case plates at the site of said second hole, said output connector having coaxial inner and outer conductors, said inner conductor of said output connector being coupled to said second protrusion in the vicinity of the tip thereof through said second hole, said inner and outer conductors of said output connector being adapted for connection to said pair of output conductors, respectively.

11. An interdigital bandpass filter having a resonator accommodating space therein comprising:

an upper case plate defining the top of said resonator accommodating space;

a lower case plate defining the bottom of said resonator accommodating space;

an upper spacer plate having an opening for defining part of the side of said resonator accommodating space;

a lower spacer plate having an opening for defining part of the side of said resonator accommodating space; and a resonator plate sandwiched between said upper and said lower case plates through said upper and lower spacer plates, said resonator plate having an opening for defining part of the side of said resonator accommodating space and integrally including a plurality of resonator elements extending in a common resonator plane within said resonator accommodating space;

an input conductor coupling member for providing a coupling between a pair of input conductors and one of said plurality of resonator elements of said resonator plate, said input conductor coupling member extending from the outside of said bandpass filter into said resonator accommodating space in a direction intersecting with said common resonator plane, said input conductor coupling member comprising:

a first notch formed in said resonator plate adjacent to said opening and in the vicinity of a tip of said one resonator element of said resonator plate;

a first protrusion extending from the tip of said one resonator element into said first notch and being integral with said one resonator element;

a notch formed in each of said upper and lower spacer plates to be matched with said first notch of said resonator plate; and a first hole formed through one of said upper and said lower case plates and having an axis thereof substantially orthogonal to the upper surface of said first protrusion in the vicinity of a tip thereof, an output conductor coupling member for providing a coupling between a pair of output conductors and another one of said plurality of resonator elements of said resonator plate, said output conductor coupling member extending from the outside of said bandpass filter into said resonator accommodating space in a direction intersecting with said common resonator plane, said output conductor coupling member comprising:

a second notch formed in said resonator plate adjacent to said opening and in the vicinity of a tip of said another one of said plurality of resonator elements of said resonator plate;

a second protrusion extending from the tip of said another one of said plurality of resonator elements into said second notch and being integral with said another one of said plurality of resonator elements;

a notch formed in each of said upper and lower spacer plates to be matched with said second notch of said resonator plate; and a second hole formed through said one of said upper and said lower case plates and having an axis thereof substantially orthogonal to the upper surface of said second protrusion in the vicinity of a tip thereof;

an input cable having inner and outer conductors, said inner conductor extending through said first hole from the outer surface of said one of said upper and said lower case plates and being connected to said first protrusion in the vicinity of the tip thereof, said outer conductor being connected to said one of said upper and said lower case plates around said first hole thereof, said inner and outer conductors of said input cable comprising said pair of input conductors, respectively; and an output cable having inner and outer conductors, said inner conductor extending through said second hole from the outer surface of said one of said upper and said lower case plates and being connected to said second protrusion in the vicinity of the tip thereof, said outer conductor being connected to said one of said upper and said lower case plates around said second hole thereof, said inner and outer conductors of said output cable comprising said pair of output conductors, respectively.

12. A method of forming an interdigital bandpass filter comprising:

providing a space for accommodating a resonator;

providing a plate integrally including a plurality of resonator elements, said resonator elements being arranged to extend in a common plane in said resonator accommodating space;

providing an input conductor coupling portion extending in a direction intersecting with said common plane to said resonator accommodating space for coupling an input conductor to one of said plurality of resonator elements; and providing an output conductor coupling portion extending in a direction intersecting with said common plane to said resonator accommodating space for coupling an output conductor to another one of said plurality of resonator elements.

13. A method according to claim 12, further comprising forming said plurality of resonator elements by machining said plate using a laser.

14. A digital bandpass filter having a space for accommodating a resonator, said filter comprising:

a plate integrally including a plurality of resonator elements, said resonator elements being arranged to extend in said resonator accommodating space, said plurality of resonator elements extending in a common plane;

an input conductor coupling portion extending in a direction intersecting with said common plane to said resonator accommodating space for coupling an input conductor to one of said plurality of resonator elements; and an output conductor coupling portion extending in a direction intersecting with said common plane to said resonator accommodating space for coupling an output conductor to another one of said plurality of resonator elements.

* * * * *